US008061165B1

(12) United States Patent
Cassini

(10) Patent No.: US 8,061,165 B1
(45) Date of Patent: Nov. 22, 2011

(54) DOOR LATCH

(76) Inventor: David Cassini, Lafayette, IN (US)

( * ) Notice: Subject to any disclaimer, the term of this patent is extended or adjusted under 35 U.S.C. 154(b) by 0 days.

(21) Appl. No.: 13/079,062

(22) Filed: Apr. 4, 2011

Related U.S. Application Data

(63) Continuation of application No. 12/636,942, filed on Dec. 14, 2009, now Pat. No. 7,942,027.

(51) Int. Cl.
*E05B 65/08* (2006.01)

(52) U.S. Cl. ..... 70/99; 70/91; 70/95; 70/136; 70/150; 70/210; 70/465; 70/DIG. 42; 292/DIG. 46; 292/DIG. 65; 292/110; 292/113; 292/100; 292/200; 292/226

(58) Field of Classification Search ..... 70/91, 95–100, 70/135, 136, 139, 150, 470, 379 R, 208, 210, 70/218, 465, DIG. 42; 292/25, 68, 110, DIG. 46, 292/DIG. 65, 95, 113, 121, 126, 100, 219, 292/200, 226
See application file for complete search history.

(56) References Cited

U.S. PATENT DOCUMENTS 2,917,915 A * 12/1959 Rainman ..... 70/100
7,942,027 B1 * 5/2011 Cassini ..... 70/91

* cited by examiner

*Primary Examiner* — Suzanne Barrett
(74) *Attorney, Agent, or Firm* — Woodard Emhardt Moriarty McNett & Henry LLP

(57) ABSTRACT

A door latch for securing a door of a building in a closed condition, the door latch including a housing, a handle rod, a lock set assembled into the housing and including a movable key tab, a main lock pivotally connected to the handle rod and including a connecting slot, the main lock being movable for lifting an engagement end, an unlocking latch pivotally connected to the handle rod and including an engagement structure for coupling with the connecting slot and a lock bar assembled to the housing and being movable relative to the housing between a locked position and an unlocked position. Wherein, when the lock bar is in the locked position, the main lock is not pivotable from a position exterior to the building by the use of the handle rod, the main lock being pivotable from a position interior to the building by manual lifting.

24 Claims, 19 Drawing Sheets

DOOR LATCH

CROSS REFERENCES TO RELATED APPLICATIONS

This application is a continuation of application Ser. No. 12/636,942 now U.S. Pat. No. 7,942,027, filed Dec. 14, 2009, which is hereby incorporated by reference in its entirety.

BACKGROUND OF THE INVENTION

The door latch assembly disclosed herein relates generally to the task of securing a sliding door of a structure in a closed condition by the use of a latch arrangement which is releasable from the inside of the structure. Locking, securing, and latching devices for structures with openable and closeable doors (or windows) are well known. However, one field where there has been limited attention over the years relates to large sliding doors which are often found as part of farm buildings, such as barns.

The more common securing techniques for large, sliding barn doors include the use of a simple latching bar or link chain run through handles. If the property owner wants to lock the doors together in a closed condition, a shackle lock can be used to secure the link chain in a closed loop. However, these particular locking and securing techniques do not enable unlocking or unlatching from the interior of the corresponding structure. These techniques may not even enable the opening of the latching bar from the interior even when there is no corresponding locking. These design realities have two important consequences. First, if someone is still in the interior of the barn when the sliding doors are locked from the outside, that person is trapped inside. This may be one reason why a smaller "pedestrian" access door could be included as part of a barn structure. Secondly, if a person is working inside the barn and, for security reasons, wants to be locked inside, this is not an option with these conventional locking or securing techniques. Related to this desire for added security is the desire to not allow an unauthorized person to unlock the door from the outside when that door is locked from the inside.

Another consideration in the locking or securing of large, sliding barn doors is the size of the doors, most notably their height. A selected door latch would advantageously include the option of adding a second and perhaps a third latching point spaced above (or below) the primary latching location. The point is that with a door which might be in the range of twelve (12) to sixteen (16) feet wide and in the range of twelve (12) to sixteen (16) feet high, more than one latching location is desirable. However, if the second latching location is higher than eight (8) feet, most individuals will not be able to reach it. This is why a single unlocking or release action needs to be cooperatively linked to all of the other latching structures, regardless of the number or location which are assembled to the same sliding door.

An improvement to the current locking and securing techniques used for large, sliding barn doors is provided by the door latch which is disclosed herein. More specifically, the disclosed door latch structure includes an optional key lock (i.e., a key-operable lock set) and a linkage arrangement to enable opening (i.e., unlocking) from the interior of the structure as well as locking from the interior. While the focus of this disclosure is directed to large, sliding barn doors, the disclosed door latch could be used for virtually any style of door which has an inner face edge which abuts up against a door jamb or up against an inner face edge of an abutting second door.

BRIEF SUMMARY

Disclosed is a door latch for securing a door of a building in a closed condition, the door latch including a housing, a handle rod assembled into the housing, a key-operable lock set assembled into the housing and including a movable key tab, a main lock pivotally connected to the handle rod and including a connecting slot, the main lock being constructed and arranged so as to be movable for lifting an engagement end, an unlocking latch pivotally connected to the handle rod and including an engagement structure for operatively coupling with the connecting slot and a lock bar assembled to the housing and being movable relative to the housing between a locked position and an unlocked position. Wherein, when the lock bar is in the locked position, the main lock is not pivotable from a position exterior to the building by use of the handle rod, the main lock being pivotable from a position interior to the building by manual lifting.

One object of the present disclosure is to describe an improved door latch for a building.

DETAILED DESCRIPTION

Figure 1:
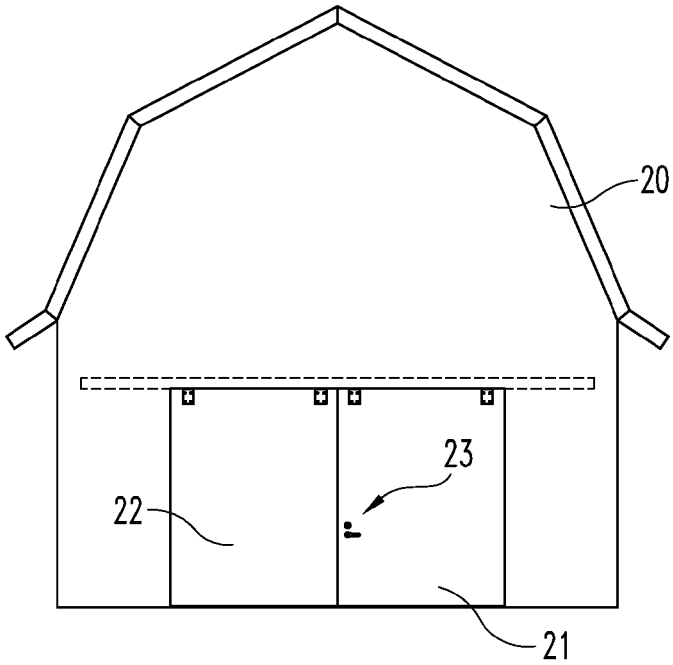
FIG. 1 is a front elevational view of a building with a double sliding door which includes a door latch according to the present disclosure.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

The present disclosure relates generally to locking and latching mechanisms for doors and/or similar movable panel-like structures such as windows and partitions. More specifically, the present disclosure relates to door latches which are used for sliding doors in order to secure the door(s) in a closed condition.

As used herein, the phrase "door latch" means and is intended to cover a door securing assembly as disclosed herein which includes cooperating linkage components and a capturing or receiving feature which engages another structural member. This "another structural member" is part of an adjacent or abutting second door or frame or door jamb or an equivalent structure, in the case of windows and partitions.

As used herein, "inside" and "interior" each (interchangeably) refer to the space or environment which is enclosed by the building which includes the referenced sliding door or doors. Similarly, "outside" and "exterior" are used interchangeably herein to refer to the space or environment which surrounds the building.

As used herein, in the context of the sliding door(s), a "closed" condition means that the width of the entrance opening defined by either a pair of sliding doors or a single door in cooperation with the remainder of the structure is significantly reduced in size such that free passage therethrough is essentially prevented. The use of "closed" herein does not require abutment between the two sliding doors nor does it require a locked condition.

As used herein, in the context of the sliding doors or a single door which closes against a structural portion of the building, an "open" condition means that the width of the entrance opening is wide enough for an individual or item of equipment to pass therethrough.

As used herein, in the context of position or orientation, "front" refers to a view from the outside of the building. Similarly, as used herein, in the context of position or orientation, "rear" refers to a view from the inside of the building.

Figure 1A:
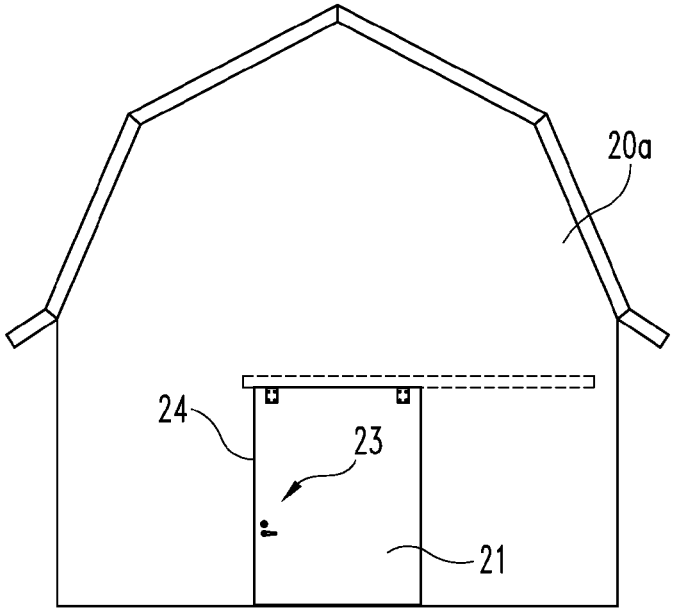
FIG. 1A is a front elevational view of a building with a single sliding door which includes a door latch according to the present disclosure.

Referring now to FIGS. 1 and 1A, there is illustrated a building 20 with a double sliding door which includes a first sliding door 21, a second sliding door 22, and a door latch 23 which is assembled into the first sliding door 21. As illustrated, the two doors 21 and 22 are drawn together into abutment or at least close proximity such that their inner facing edges (i.e., their abutment surfaces) are very close together if not actually touching. In the alternative embodiment of FIG. 1A, the second sliding door 22 is eliminated and the abutment surface 24 for the first sliding door 21 is now a fixed or stationary portion of the building 20*a*. While the buildings 20 and 20*a* are illustrated as being in the form of farm buildings, specifically barns, the door latch 23, as described herein, can be used for a wide range of movable doors (sliding or swinging) or similar movable panels, such as sliding windows and partitions. In the event door latch 23 is used on a swinging door, the capturing or receiving feature, specifically the hook extension and the bar or link portion of the second door or abutment surface which it receives or engages, may need to be reconfigured. This is due to the risk that the hook extension will interfere with the outer surface of the second door or building as the first door swings into a closing position.

Figure 2:
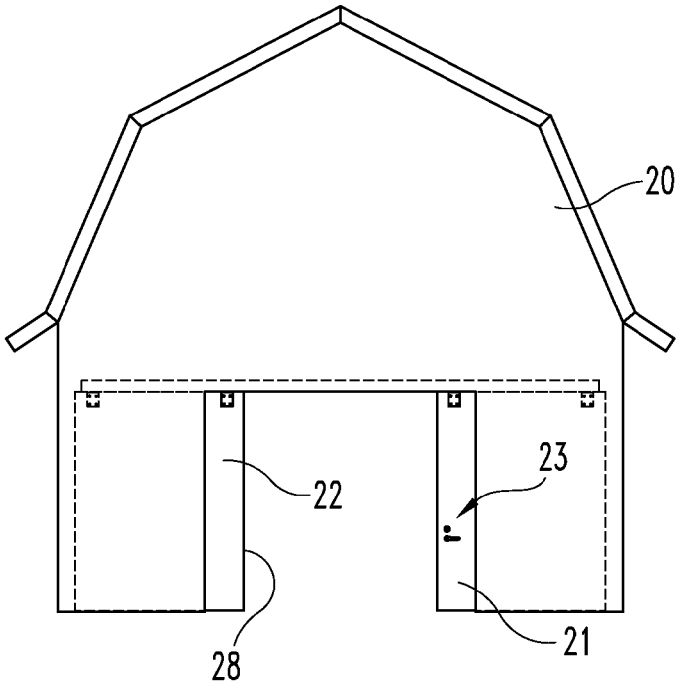
FIG. 2 is a front elevational view of the FIG. 1 building with a double sliding door in an open condition.
Figure 2A:
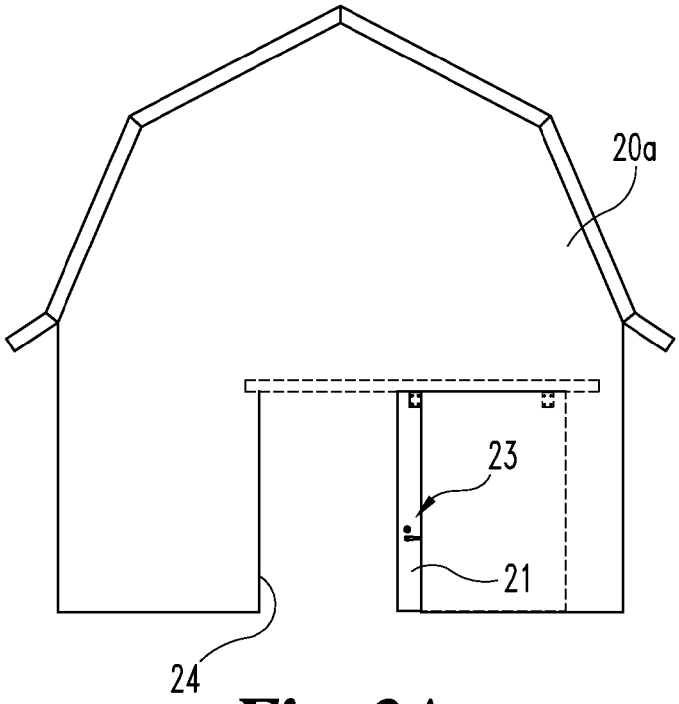
FIG. 2A is a front elevational view of the FIG. 1A building with a single sliding door in an open condition.

Referring now to FIGS. 2 and 2A, first sliding door 21 is in an open condition. The abutment surface (inner edge) 28 of the second sliding door 22 is now exposed. FIG. 4 shows the location and configuration of the bar 29 which is received by the protruding hook extension 30 (see FIG. 3). The same style of bar 29 is included as part of abutment surface 24 for the alternative construction of building 20*a*. Bar 29 is a cylindrical member which is securely assembled into its surrounding structure as a part of either door 22 or building 20*a* and is anchored into position by a suitable mechanical securing technique.

Figure 3:
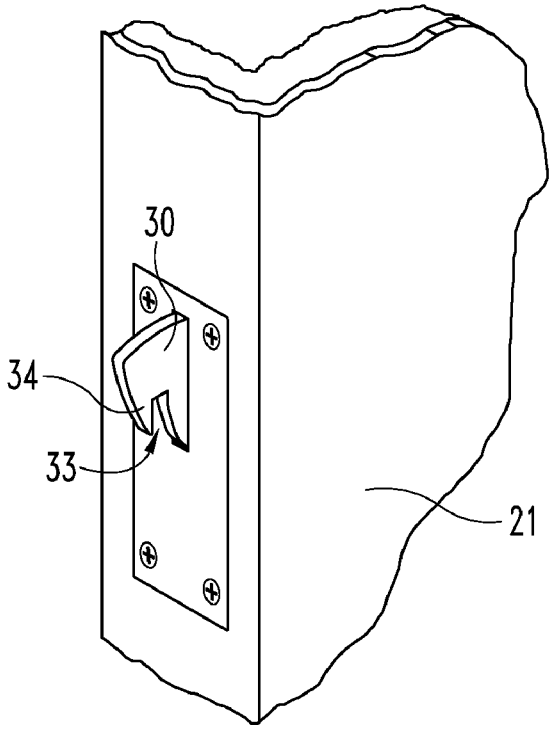
FIG. 3 is a partial perspective view of the FIG. 1 door latch, as installed into the sliding door, showing a protruding hook extension.
Figure 4:
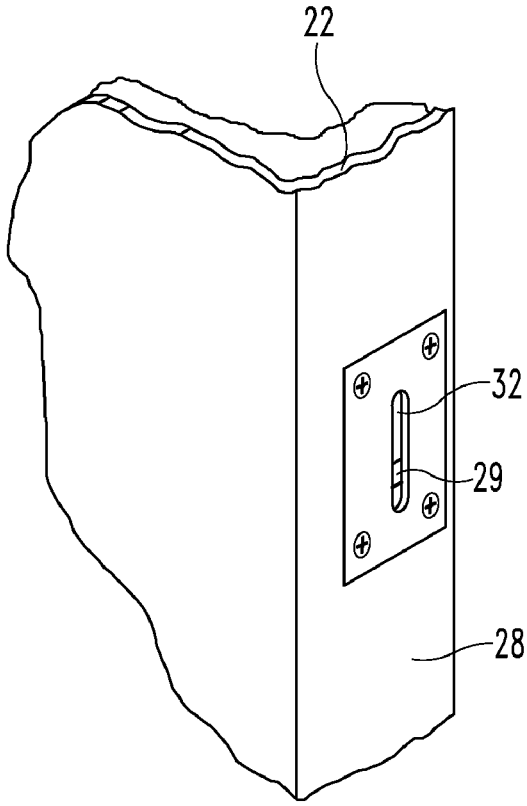
FIG. 4 is a partial perspective view of a receiving portion of the building showing a latching bar which is to be received by the hook extension.
Figure 5A:
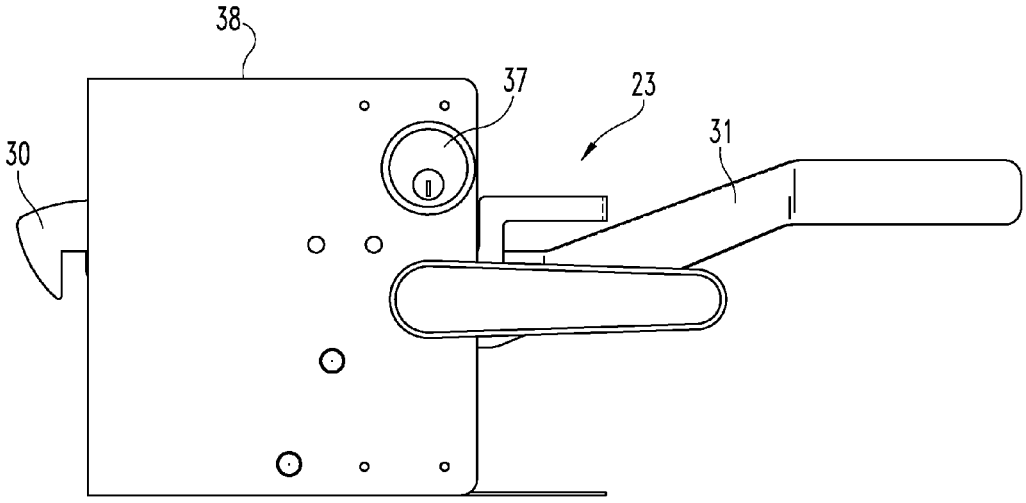
FIG. 5A is a front elevational view of the FIG. 1 door latch.
Figure 5B:
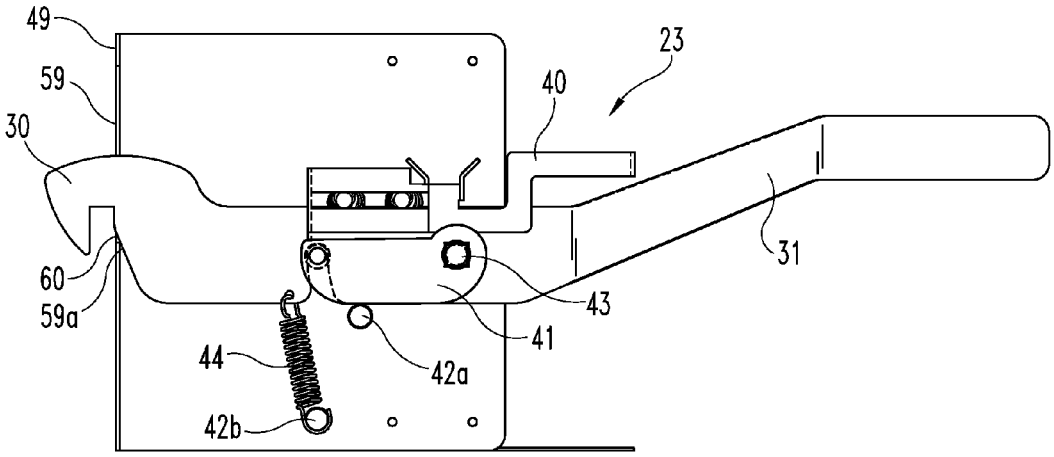
FIG. 5B is a front elevational view of the FIG. 1 door latch with a panel of the housing removed for drawing clarity.
Figure 6A:
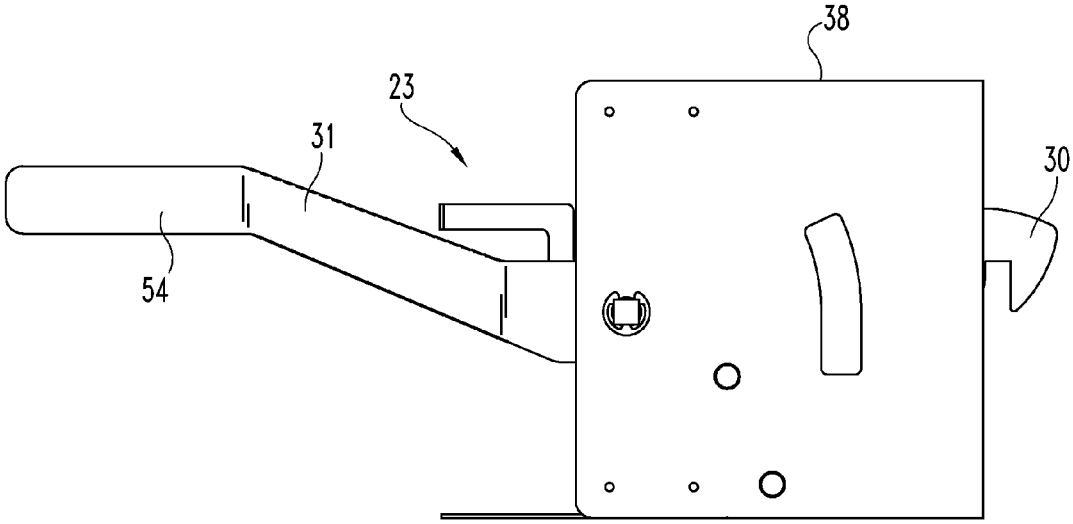
FIG. 6A is a rear elevational view of the FIG. 1 door latch.
Figure 6B:
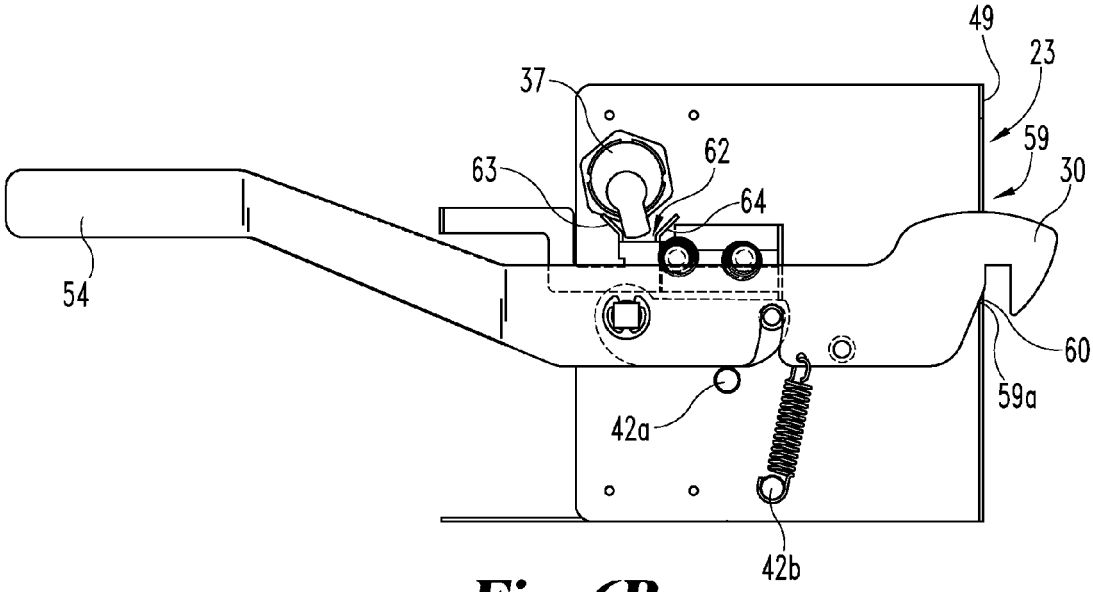
FIG. 6B is a front elevational view of the FIG. 1 door latch with a panel of the housing removed for drawing clarity.
Figure 7:
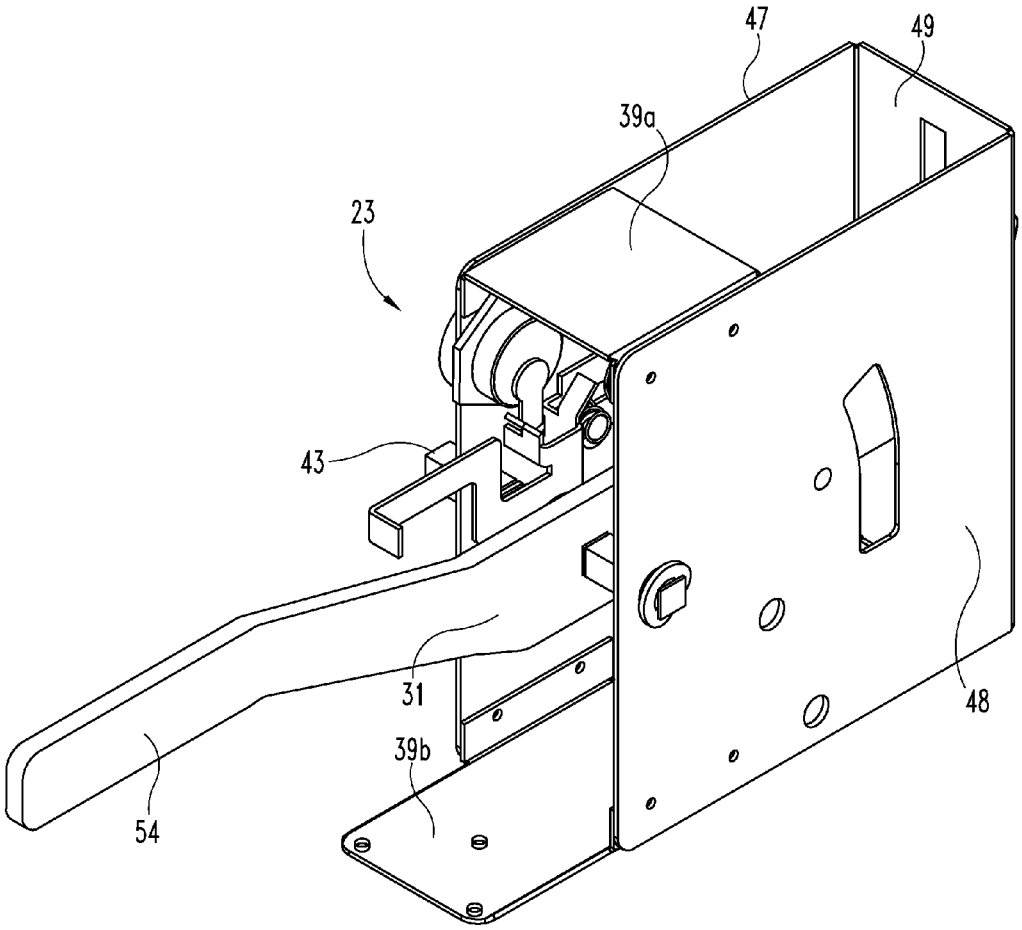
FIG. 7 is a perspective view of the FIG. 1 door latch.
Figure 8:
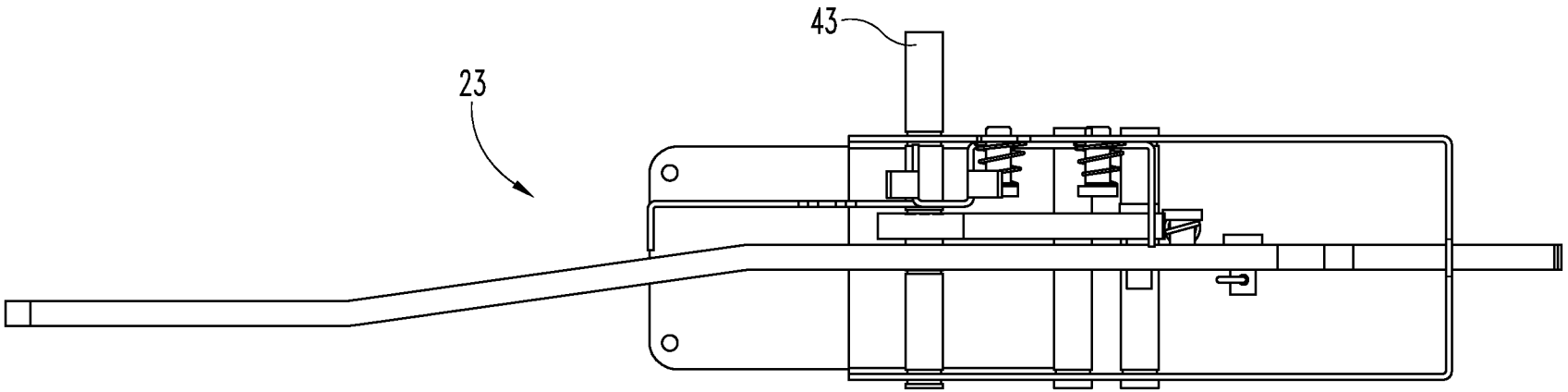
FIG. 8 is a top plan view of the FIG. 1 door latch with an upper cap removed for drawing clarity.
Figure 9:
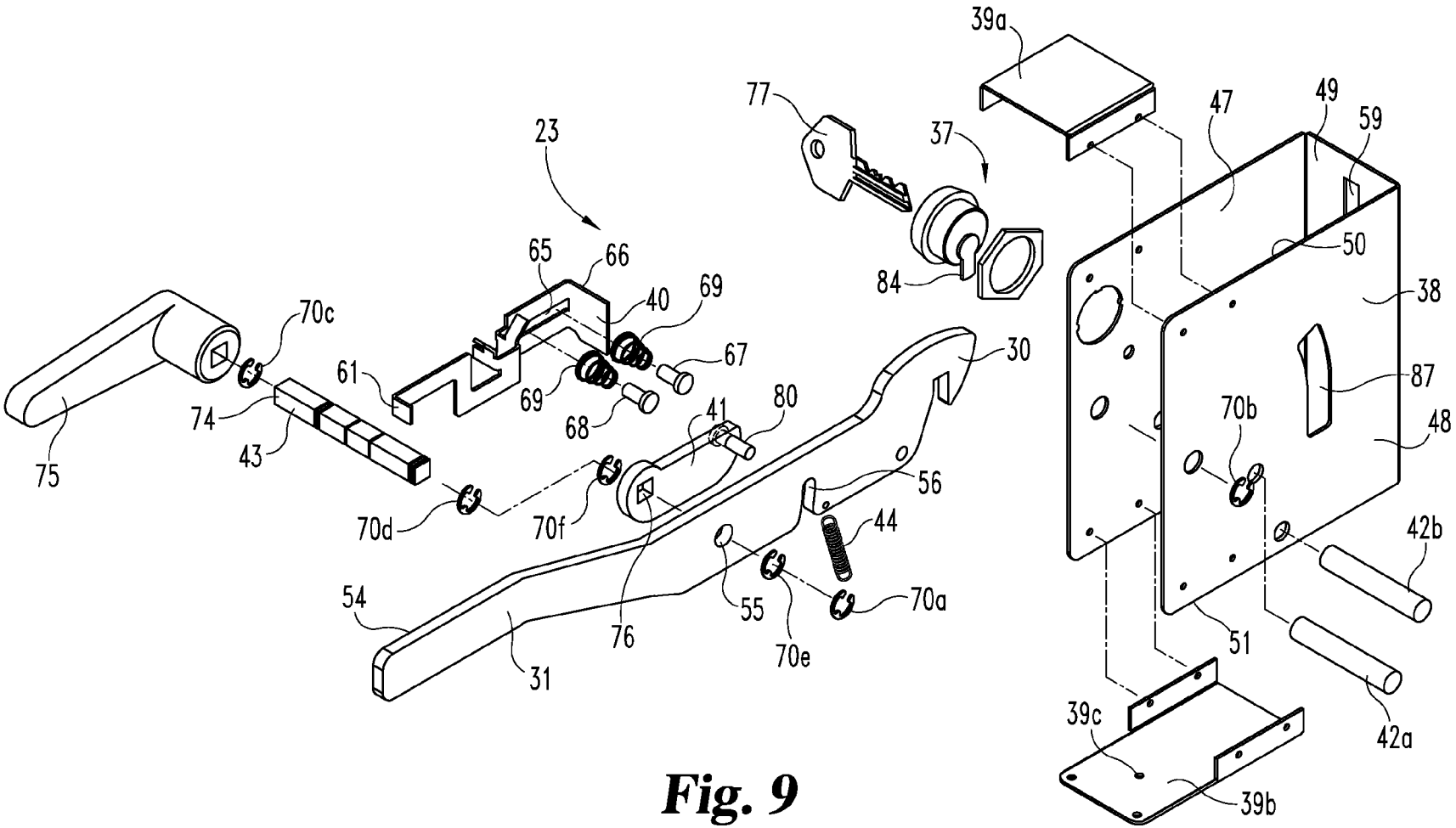
FIG. 9 is an exploded view of FIG. 1 door latch.
Figure 15:
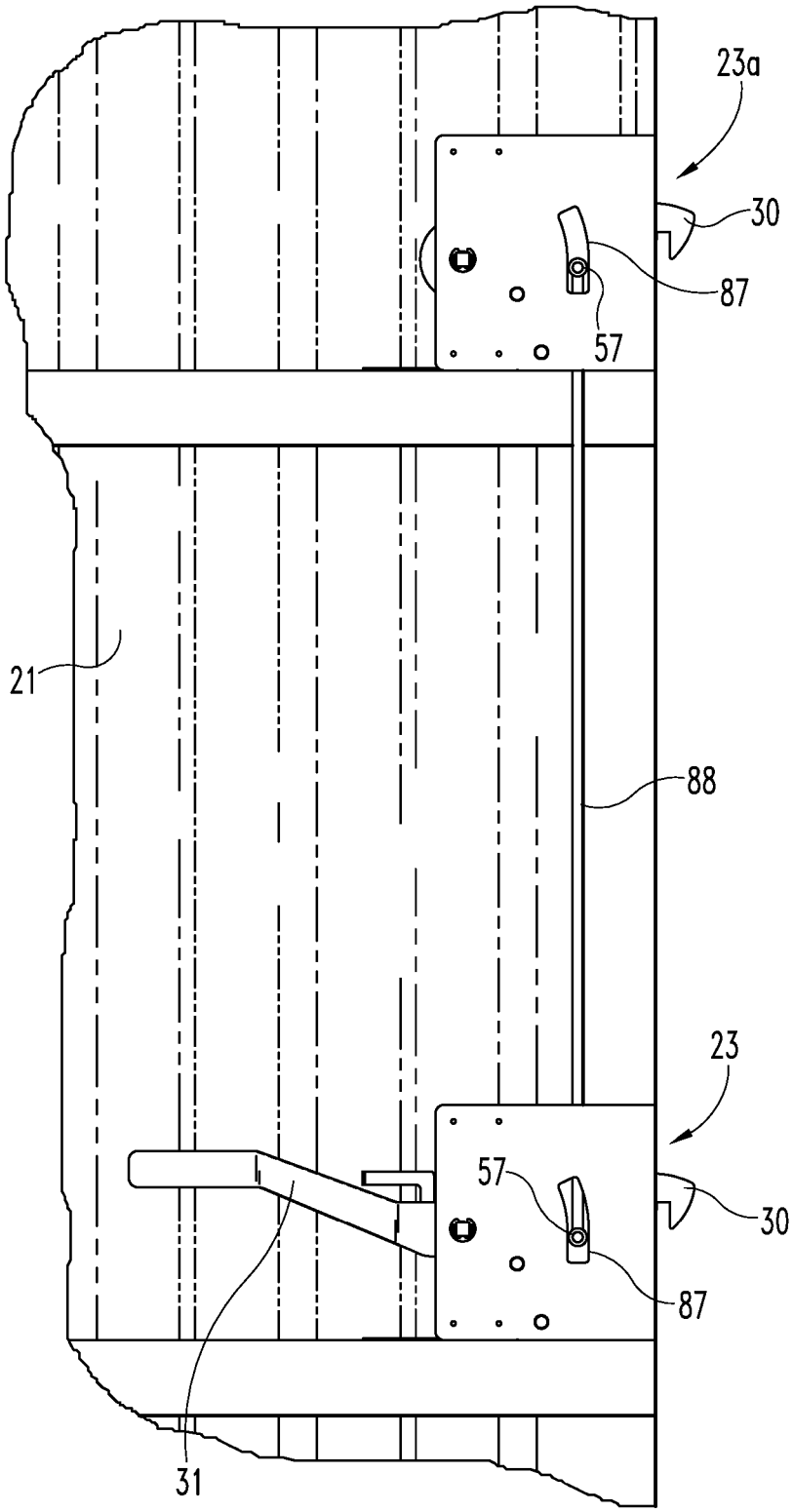
FIG. 15 is a rear elevational view of two interconnected FIG. 1 door latches utilizing a linkage bar for their interconnection.

In FIG. 3, the hook extension 30 is illustrated as it is configured relative to the first sliding door 21 when the door latch 23 is assembled into the first sliding door 21. Referring to FIG. 4, the bar 29 is illustrated as assembled and secured into its receiving structure of the second sliding door 22 with its the abutment surface 28. The alternative structure when door 22 is not presents is to use abutment surface 24 of the alternative building 20*a*. As is illustrated, door latch 23 mounts to the inside surface of the sliding door 21 and for farm barn construction, the inside surface of the first sliding door is a metal structure with open spaces for receiving door latch 23 (see FIG. 15). As will be described further in the text, hook extension 30 is one end of a main lock 31 which comprises one of the component parts of the door latch 23. When two doors are drawn together, the hook extension is lifted and inserts into a clearance slot 32 which is disposed above bar 29. Once the hook extension 30 is inserted into the clearance slot 32, it can be released so that it drops down and captures bar 29. More specifically, the notch 33 of the hook extension captures bar 29 and completes the securing together of the two doors 21 and 22 (or of door 21 with abutment surface 24). Attempts to pull apart or slide apart the two doors 21 and 22 will not be successful due to bar 29 abutment against projection 34. Until such time as hook extension 30 is lifted, such that the bar 29 comes out of notch 33, sliding door 21 is not able to be opened by sliding movement. The hook extension 30 must be lifted or raised to a location or height where the sliding apart movement does not result in bar 29 and projection 34 abutment.

Referring now to FIGS. 5A through 9, there is illustrated door latch 23 configured as a subassembly prior to being installed into the first sliding door 21. Door latch 23 includes a key-operable lock set 37 whose construction and use will be illustrated. However, the lock set 37 has been removed from some of the FIGS. 5A-9 illustrations in order to more clearly illustrate the other components and interior construction of door latch 23. In order to facilitate this sliding door installation, door latch 23 includes, as some of its primary component parts, a sheet metal housing 38, a pair of caps 39*a* and 39*b*, main lock 31, lock bar 40, unlocking latch 41, spacer rods 42*a* and 42*b*, handle rod 43, and spring 44. Related and cooperating connecting hardware is used as part of door latch 23, as illustrated and described herein.

Figure 10A:
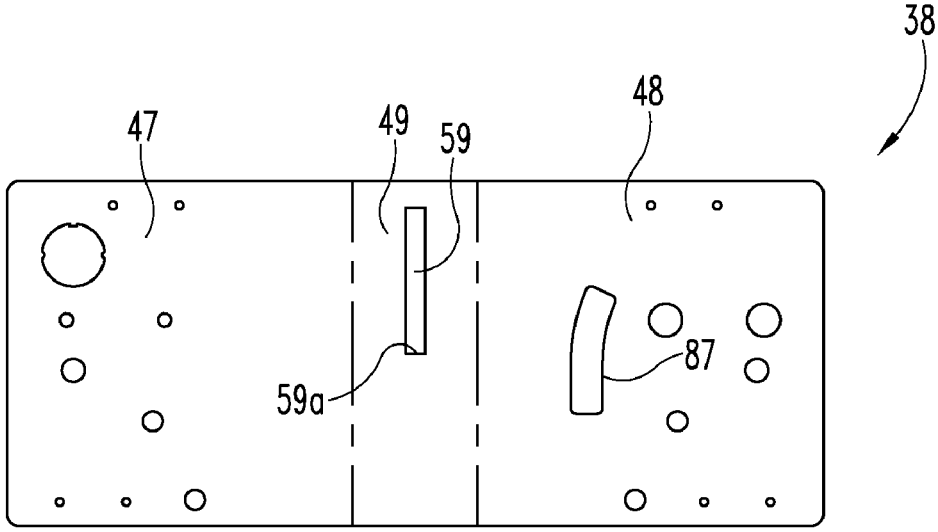
FIG. 10A is a top plan view of a housing in a pre-formed flat shape comprising a part of the FIG. 1 door latch (as formed).
Figure 10B:
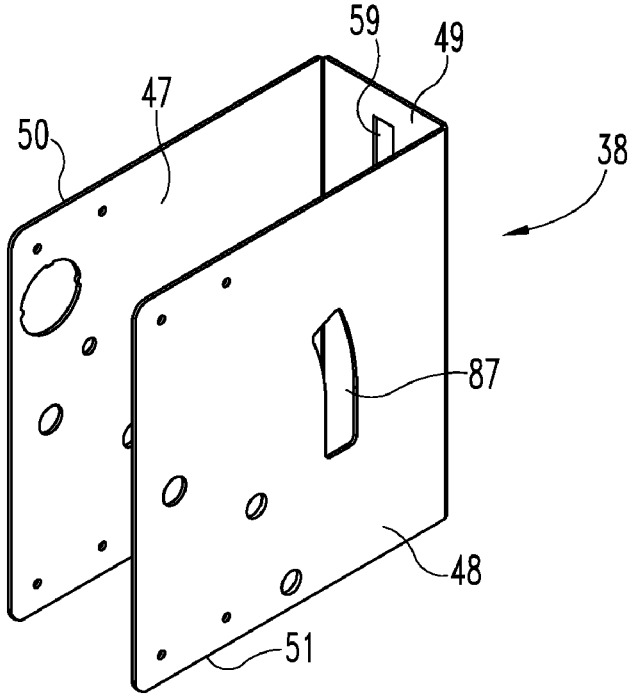
FIG. 10B is a perspective view of the FIG. 10A housing as formed for use in the FIG. 1 door latch.

As illustrated, housing 38 is a generally U-shaped, unitary member with a front or outer panel 47, a rear or inner panel 48, and a connecting end panel 49. Prior to being shaped into the three-panel form, housing 38 begins as a flat form as illustrated in FIG. 10A. The three-panel form is illustrated in FIG. 10B. Each cap 39*a* and 39*b* extends between the outer and inner panels 47 and 48 and each cap is riveted to each panel. Upper cap 39*a* is riveted into position adjacent the upper edge 50 of housing 38. Lower cap 39*b* is riveted into position adjacent the lower edge 51 of housing 38. Caps 39*a* and 39*b* provide added rigidity to housing 38 and provide some degree of enclosing protection for the components assembled in between housing panels 47 and 48. As such, the size and location of caps 39*a* and 39*b* can be changed depending on the design preferences and the anticipated receiving door structure. Lower cap 39*b* includes an extension portion 39*c* which is used to help secure the door latch 23 into the first sliding door 21.

The main lock 31 (see FIGS. 14A and 14B) is formed with an off-set handle 54, a rod clearance hole 55, a slot 56, a linkage pin hole 57, and a spring hole 58. Main lock 31 also includes the hook extension 30. End panel 49 of housing 38 is formed with a generally rectangular clearance slot 59 and hook extension 30 extends through slot 59. The notch 33 portion of main lock 31 protrudes beyond the surface of end panel 49. However, there is an edge portion 60 of main lock 31 inwardly from notch 33 which is constructed and arranged so as to abut up against the lower edge 59*a* of slot 59. As will be described, main lock 31 is spring biased, tending to pull hook extension 30 in a downward direction. The abutment between a portion of main lock 31 and the lower edge of slot 59 maintains the main lock 31 in its desired orientation, even though it is spring-biased. Handle rod 43 extends through hole 55 so as to permit pivoting movement of main lock 31 about the longitudinal axis of handle rod 43.

Figure 11A:
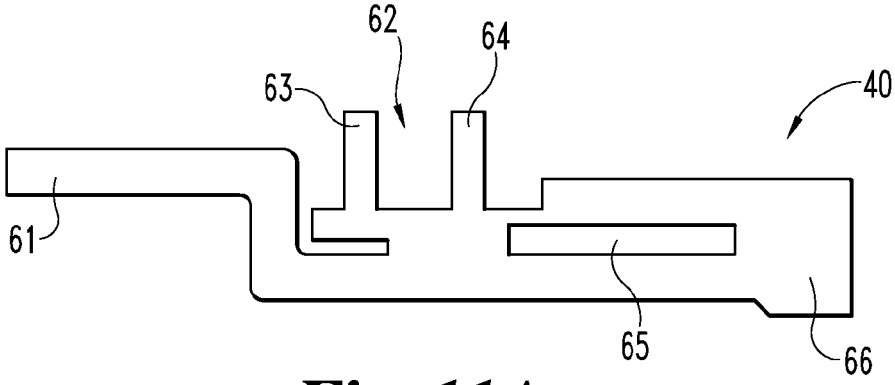
FIG. 11A is a top plan view of a lock bar in a pre-formed flat shape comprising a part of the FIG. 1 door latch.
Figure 11B:
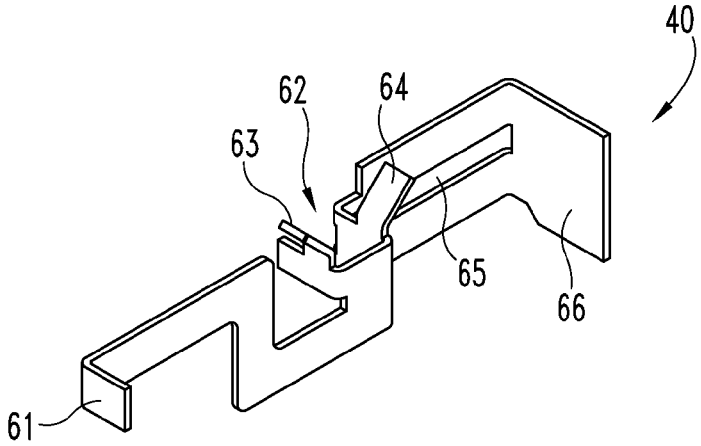
FIG. 11B is a perspective view of the FIG. 11A lock bar as formed for use in the FIG. 1 door latch.

One embodiment of lock bar 40 is a sheet metal form which begins flat and is bent so as to create the configuration which is illustrated in FIGS. 5A-9. The starting flat form of lock bar 40 is illustrated in FIG. 11A and the bent or formed configuration of lock bar 40, as a perspective view, is illustrated in FIG. 11B. An alternate construction (see FIGS. 16 and 17) for lock bar 40 is to laser cut the required shapes from bar stock. The laser cut construction should enable one to hold tighter or closer tolerances if that is deemed desirable or necessary relative to any cost trade offs. Lock bar 40 includes a release lever 61, key lock channel 62 which is defined by formed tabs 63 and 64, slot 65, and locking abutment 66. Lock bar 40 is secured to the outer panel 47 by the use of two headed, straight cylindrical pins 67 and 68. Each pin 67 and 68 includes a first end which extends through outer panel 47 and an opposite end which extends through slot 65. The enlarged head of each pin 67 and 68 cooperates to capture a corresponding biasing spring 69 which is positioned between the enlarged head and the surface of the lock bar 40 which defines and surrounds slot 65. These two biasing springs 69 provide for a smooth and controlled side-to-side sliding movement of lock bar 40. The two pins 67 and 68 remain fixed relative to the housing 38 and the slot 65 of the lock bar 40 rides across the body of each pin as the lock bar travels laterally (i.e., substantially perpendicular to the plane of end panel 49). The ends of each pin 67 and 68 may be secured by the use of a cotter pin (not illustrated). As an alternative, these ends can be headed, similar to the use of a rivet to prevent push or pull out. As will be described in greater detail later, lock bar 40 is moved laterally by turning of the key in the key-operable lock set 37 or manually by the user in the interior of the building by means of release lever 61.

Figure 12:
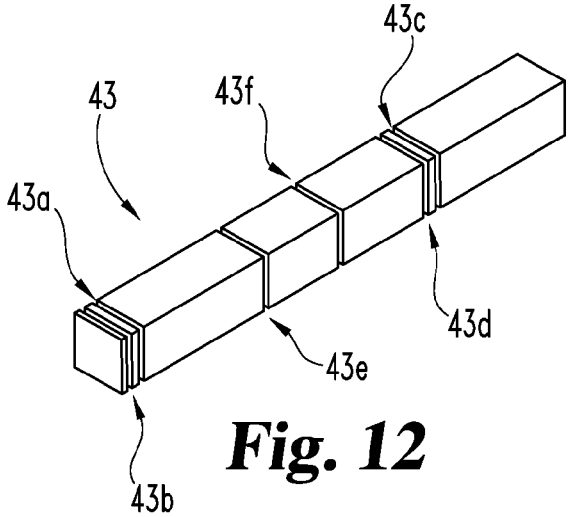
FIG. 12 is a perspective view of a handle rod comprising a part of the FIG. 1 door latch.

Handle rod 43 is an axially straight rod which extends through outer panel 47 and through inner panel 48 and is secured to the housing in that manner. An extension portion 74 receives handle 75 with a secure connection such that there is no relative motion between the handle rod 43 and the handle 75. The configuration of handle rod 43 (see FIG. 12) with its square body and cylindrical grooves 43*a*-43*d*, allows the handle rod 43 to freely turn or rotate within the receiving holes in the outer and inner panels 47 and 48, using front and rear retaining rings 70*a*, 70*b*, 70*c* and 70*d* to secure handle rod 43 within the two panels. Handle rod 43 also extends through square opening 76 in unlocking latch 41 and through circular opening 55 in main lock 31. Two more retaining rings 70*e* and 70*f* are used for cylindrical grooves 43*e* and 43*f*. The construction of square opening 76 relative to the square construction (i.e., the lateral section shape) of handle rod 43 causes the unlocking latch 41 to pivot with the turning of handle 75 about the longitudinal axis of handle rod 43. There is no relative motion or turning motion between the handle rod 43 and unlocking latch 41. In the case of main lock 31, its circular clearance opening 55 is constructed and arranged relative to handle rod 43 such that when pivoting of unlocking latch 41 is restricted by lock bar 40, main lock 31 pivots independently of handle rod 43 and independently of locking latch 41. This can only be done from the interior of the building using the main lock 31. When the unlocking latch 41 is not restricted by the lock bar 40, then clockwise turning of handle 75 pivots both main lock 31 and unlocking latch 41. Pulling down on lock bar 40 from the interior of the building causes the handle 75, handle rod 43, lock bar 40, and unlocking latch 41 to all pivot or turn together.

When facing the outer panel 47, the only permissible direction of turning or rotation of handle rod 43 is in a clockwise direction. The use of spring 44 provides an automatic spring return in a counterclockwise direction. In the initial position of handle rod 43 (i.e., after spring return), the handle rod 43 can only be turned in a clockwise direction due to structural abutments designed into the overall construction of door latch 23.

Figure 13A:
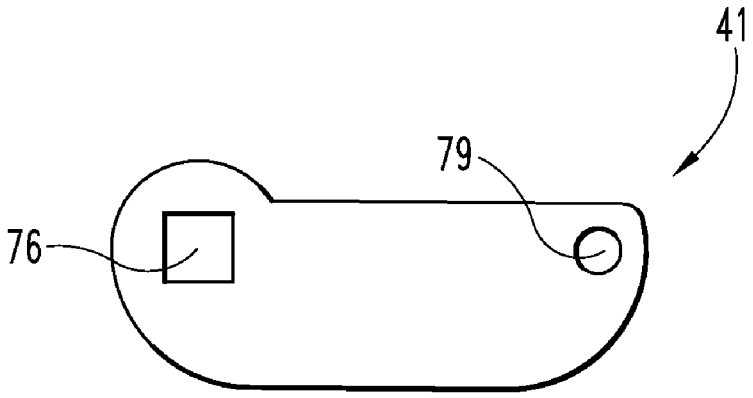
FIG. 13A is a rear elevational view of an unlocking latch comprising a part of the FIG. 1 door latch.
Figure 13B:
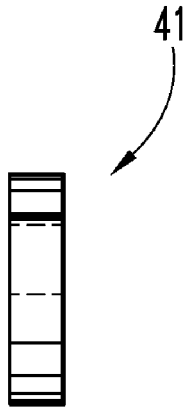
FIG. 13B is an end elevational view of the FIG. 13A unlocking latch.

Unlocking latch 41 (see FIGS. 13A and 13B) includes a second opening 79 which receives a pin 80 in a securely fixed position. Pin 80 rides in slot 56 which is defined by main lock 31. This allows the main lock 31 to pivot independently of the unlocking latch 41 when the unlocking latch 41 is restricted by sliding locking abutment 66 to a position over the unlocking latch 41. When the locking abutment 66 is moved laterally into this blocking position over the unlocking latch 41, neither the handle 75 nor the handle rod 43 are able to turn, thereby locking the sliding door such that it cannot be opened (assuming proper engagement between hook extension 30 and bar 29), without the key 77 being utilized in the lock set so as to turn a movable key tab. However, if the occupant of the building has the key and wants to lock the sliding door while working within the building, the lock bar 40 simply needs to be moved (manually) into the blocking position relative to the unlocking latch 41. This action will prevent opening of the sliding door by an unauthorized (i.e., without the key) person.

Assuming that the sliding door 21 is in a closed and latched condition although unlocked, when the lock bar 40 (specifically locking abutment 66) has not moved into a blocking over unlocking latch 41 (i.e., unlocked), clockwise movement of handle 75 (oriented as facing the building from the exterior) causes main lock 31 to pivot about handle rod 43, thereby lowering offset handle 54 and raising hook extension 30. The raising of hook extension 30 disengages this structure from its capture of bar 29 and allows sliding door 21 to slide open. If the building construction includes a second sliding door 22, then this unlatching action allows sliding door 22 to also slide open. If the door latch 23 is locked, then either the lock set 37 must be used from the exterior in order to shift the position of lock bar 40 or the lock bar 40 must be moved (manually) to an unlocked position from the interior of the building in order to grant access to a person outside of the building. Lock bar 40 must be moved by some means in order to permit raising of the hook extension by means of handle 75. However, even in the locked condition, the offset handle 54 can be manually lowered from the interior of the building so as to unlatch hook extension 30 from bar 29. When the lock bar 40 is in the locked position over unlocking latch 41, the hook extension 30 cannot be unlatched from the bar 29 by the use of handle 75 until the lock bar 40 is moved out of its locking (i.e., blocking) position over unlocking latch 41. The main lock 31 can always be pivoted from the interior to open door 21.

The lock set 37 includes a key tab 84 which extends downwardly into lock channel 62 between the two, spaced-apart formed tabs 63 and 64 of lock bar 40. These two formed tabs 63 and 64 are each shaped with a curved and inclined surface and these inclined surfaces are directed in a converging manner toward the interior of lock channel 62. As key tab 84 is turned due to the action of turning the key 77 from the exterior of the building, one or the other of the formed tabs 63 and 64 is contacted by the key tab 84. This contact and the continued turning of the key causes the lock bar 40 to move laterally, either into or out of a locking position, relative to unlocking latch 41, depending on the starting position of lock bar 40.

Figure 14A:
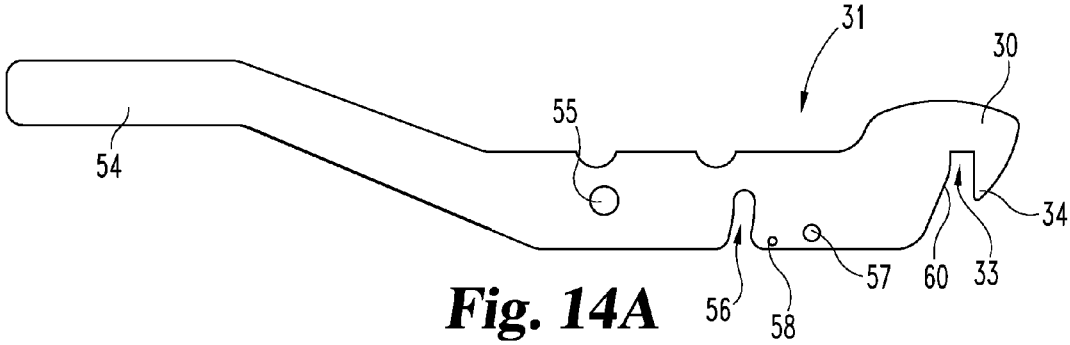
FIG. 14A is a rear elevational view of a main lock comprising a part of the FIG. 1 door latch.
Figure 14B:
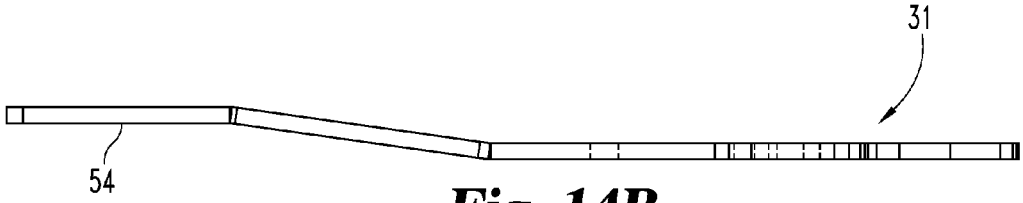
FIG. 14B is a top plan view of the FIG. 14A main lock.

Referring to FIGS. 14A and 14B, further construction details of the main lock 31 are illustrated. Main lock 31, as has already been described, includes the offset handle 54, hook extension 30, rod clearance hole 55, slot 56, linkage pin hole 57, and spring hole 58. Spring 44 has one end formed with a hook portion which extends through hole 58. The opposite end of spring 44 is secured around the lower spacer rod 42*a*. Since the lower spacer rod 42*a* is fixed in position relative to the housing 38, the pivoting motion of main lock 31, as the offset handle 54 is lowered, extends spring 44 and increases the spring-biasing force on the main lock. This spring-biasing force causes a return of the main lock 31 to its normal at-rest position, as is illustrated in FIGS. 5A-6B. However, it is noted that there is an abutment between a portion 60 of the main lock 31 and the lower edge 59*a* of the slot 59 which establishes the normal or at-rest position for main lock 31. A modest amount of spring tension exists even in this at-rest position as a way to keep the main lock 31 properly positioned and seated on pin 80. This in turn reduces any looseness or lag.

The housing 38 includes a clearance slot 87 which is defined by the inner panel 48. This clearance slot 87 is in alignment with linkage pin hole 57. In the event two door latches 23 are going to be used in tandem (see FIG. 15), one above the other, the two door latches 23 need to be connected in a fashion which will allow operation of one to control the operation of the other. In theory, the only connection needed is to marry the movement of the hook extension 30 or at least that end of the main lock 31 of one door latch 23 to a corresponding location on the main lock 31 of the second door latch 23*a* (see FIG. 15). If desired, and depending on the door height, the second door latch could be similarly connected to a third door latch at another spaced-apart location, in essentially the same manner, and so forth. It should also be noted that these additional door latches do not need the offset handle 54 nor the release lever 61 since these additional door latches will only be remotely controlled via linkage bar 88.

The preferred linkage connection is to use a straight linkage bar 88 which is pinned at one end to the first main lock 31 using hole 57. The linkage bar 88 is then pinned at its opposite end to the main lock 31 of the second door latch 23 using the linkage pin hole 57 of this second main lock 31. This particular process and configuration can be sequentially repeated, as has been described.

As noted above, one design option for alternative embodiments is to change the fabrication method for the lock bar 40. Other design options for alternative embodiments include changes to some of the mounting hardware, hole locations, dimensions, some of the specific shapes selected for the component parts, and the addition of new parts for added strength and/or reliability. Some of these design options are incorporated into door latch 123, as illustrated in FIGS. 16-24.

While the primary focus of FIGS. 16-24 is directed to the change in the style of lock bar 40, now lock bar 140 in the second embodiment, the other design modifications (options) which are illustrated are also described. A "100" numbering prefix has been added and it is to be understood that these 100-series component parts are essentially the same as their counterpart in the first embodiment, except as noted herein.

Figure 16:
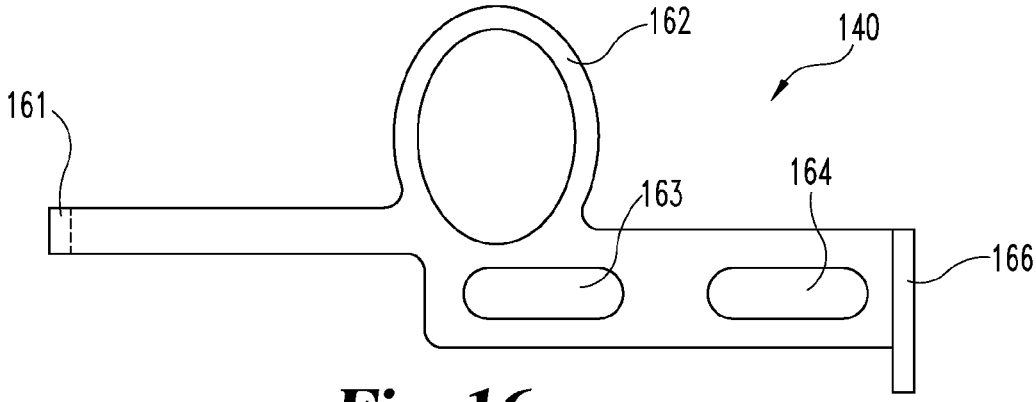
FIG. 16 is a front elevational view of an alternate lock bar for use in another door latch embodiment according to the present disclosure.
Figure 17:
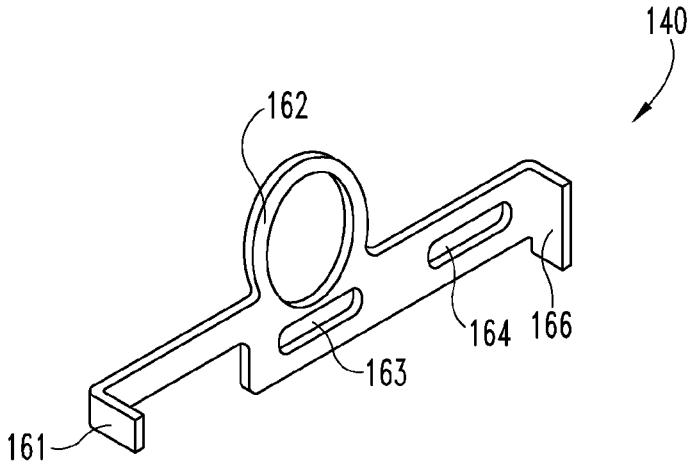
FIG. 17 is a perspective view of the FIG. 16 alternate lock bar.
Figure 18:
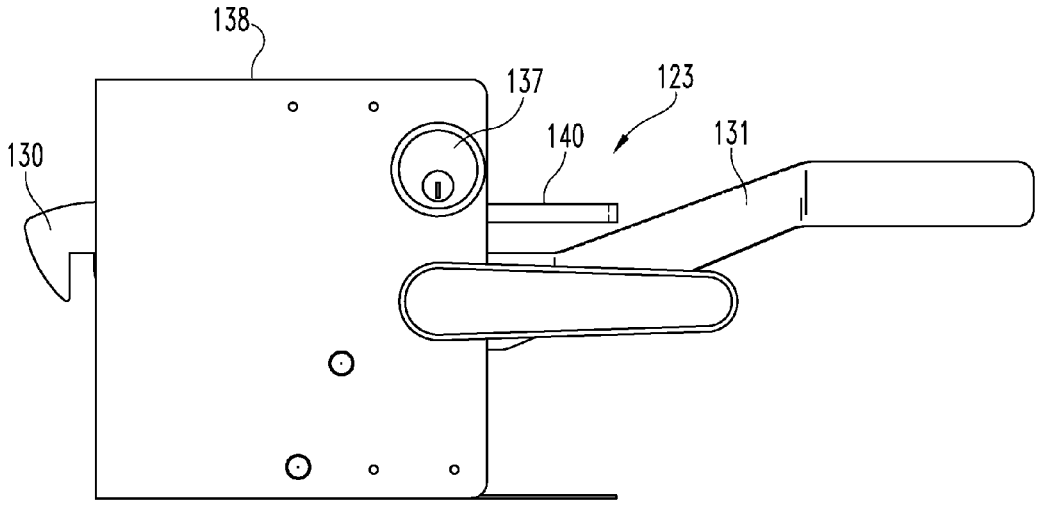
FIG. 18 is a front elevational view of the other door latch embodiment.
Figure 19:
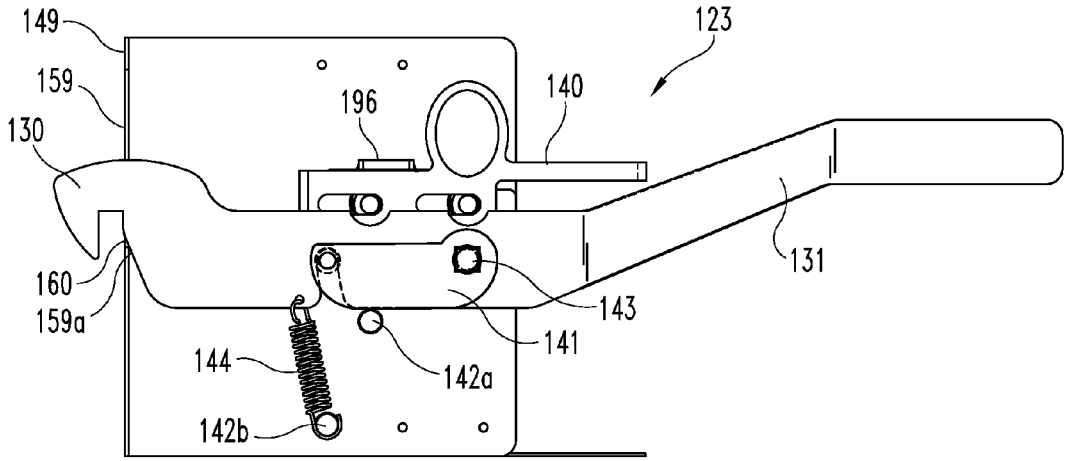
FIG. 19 is a front elevational view of the FIG. 18 door latch with a panel of the housing removed for drawing clarity.
Figure 20:
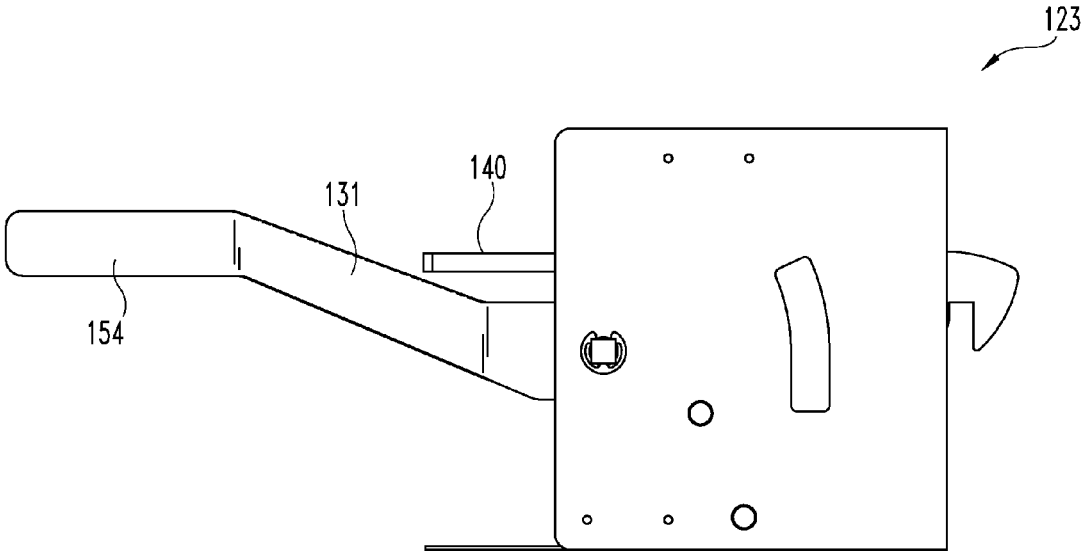
FIG. 20 is a rear elevational view of the other door latch embodiment.
Figure 21:
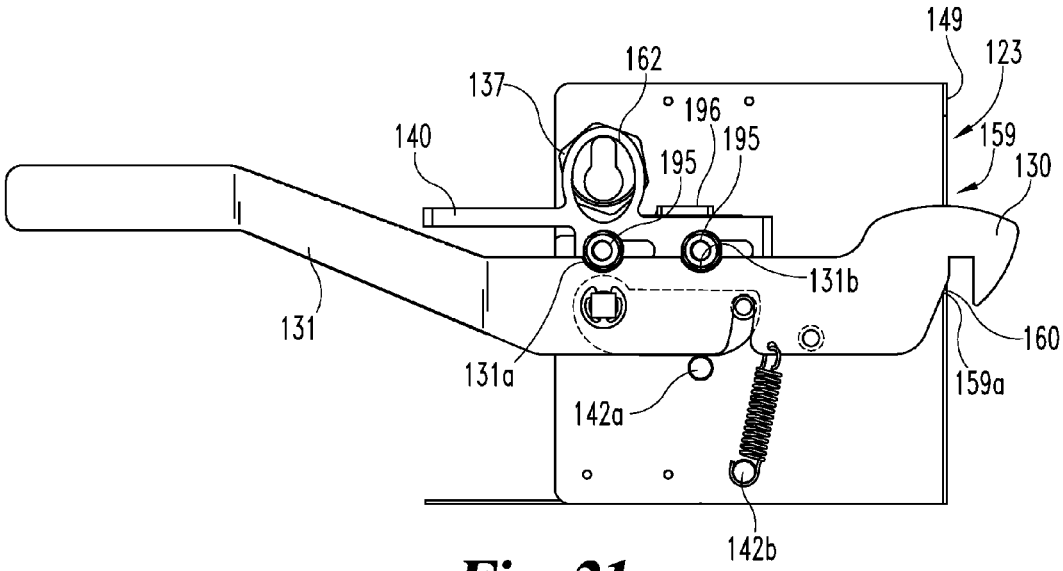
FIG. 21 is a front elevational view of the FIG. 20 door latch with a panel of the housing removed for drawing clarity.
Figure 22:
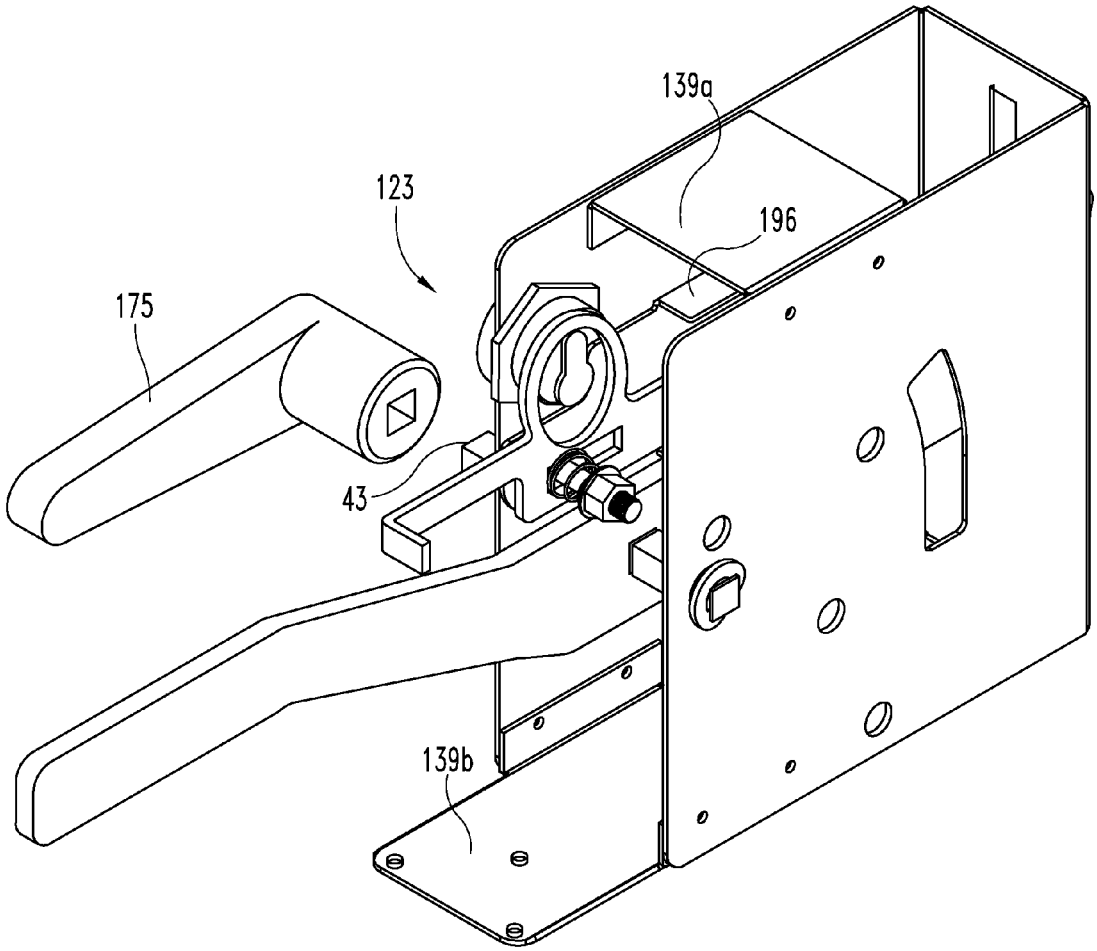
FIG. 22 is a perspective view of the other door latch embodiment.
Figure 23:
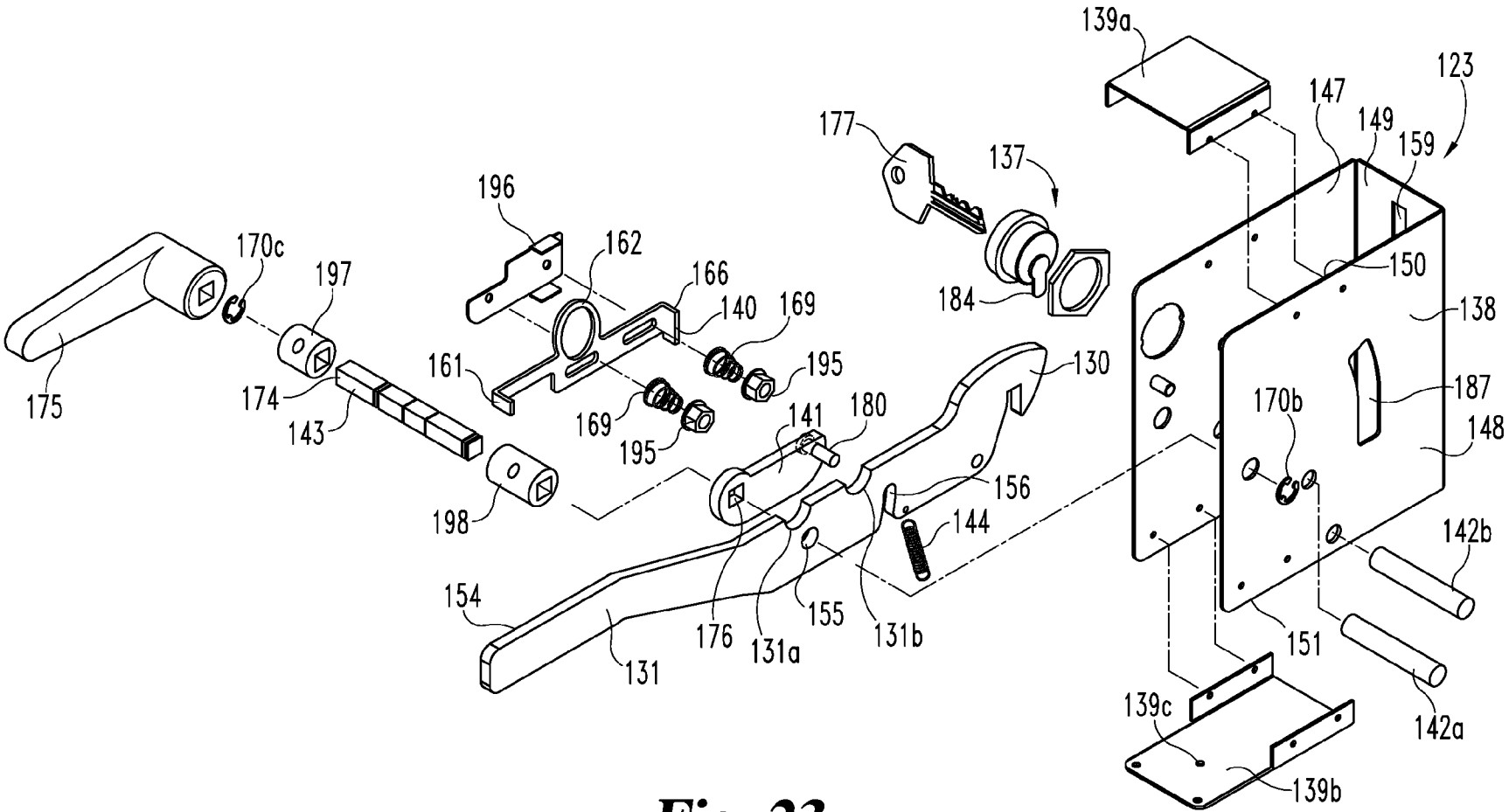
FIG. 23 is an exploded view of the other door latch embodiment.
Figure 24:
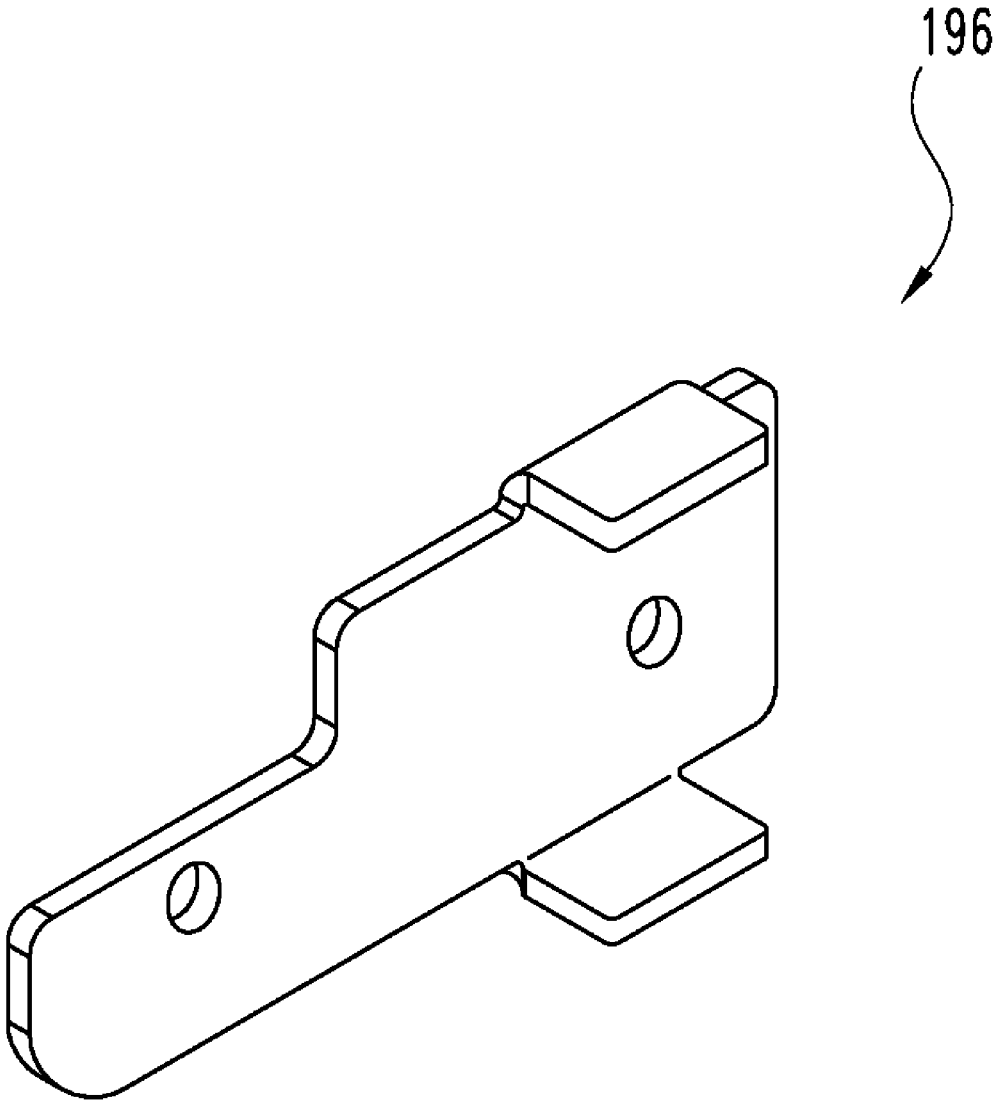
FIG. 24 is a perspective view of a guide which comprises one of the component parts of the other door latch embodiment.

Lock bar 140 is illustrated in FIGS. 16 and 17 and includes a release lever 160, an oval key loop 162, control slots 163 and 164, and locking abutment 166. The position, orientation, and assembly of lock bar 140 into the door latch 123 is further illustrated in FIGS. 18-22 and by the exploded view of FIG. 23. Although a majority of the component parts comprising door latch 123 are the same as those of door latch 23, the "100" numbering prefix has been used throughout. In part, this is done because there are a number of very slight changes to some of the component parts and in part to be consistent in the numbering of the alternate embodiment. For example, main lock 131 includes two semi-cylindrical clearance notches 131*a* and 131*b* for the hex nuts 195 which secure springs 169 in position relative to control slots 163 and 164. The 100-series referenced component parts which are not otherwise discussed are considered to have essentially the same form, fit, and function as their counterpart which is illustrated and described as a part of door latch 23.

Notwithstanding the change in the configuration and styling of lock bar 140, the basic theory of operation of door latch 123 is unchanged from that of door latch 23. The lock bar 140 is still manually slidable (side-to-side) as already described in the context of lock bar 40. The two spaced-apart slots 163 and 164 provide better control and a more reliable mechanism.

The addition of guide 196 (see FIG. 24) assists in helping to control the side-to-side sliding motion of lock bar 140. Guide 196 also helps maintain and control the axial spacing of components along the length of the handle rod 143. Key tab 184 is positioned on the interior of key loop 162 and acts against the inside surface of the defined oval (eccentric). It is the contact between the turning key tab 184 and the inside surface of key loop 162 which is used to move (slide side-to-side) the lock bar 140 in order to either lock or unlock the action of main lock 131.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A door latch for securing a door of a building in a closed condition, said door latch comprising:

a housing;

a handle rod assembled into said housing;

a key-operable lock set assembled into said housing and including a movable key tab;

a main lock connected to said handle rod and including a slot, said main lock being constructed and arranged so as to be movable for lifting an engagement end;

a latch connected to said handle rod and including slot-engagement means for operatively coupling with said slot;

a lock bar positioned in said housing and being movable relative to said housing between a first position and a second position, said lock bar defining an oval opening; and wherein when said lock bar is in said first position, said main lock is not movable from a position exterior to said building by use of said handle rod, said main lock being manually movable from a position interior to said building.

2. The door latch of claim 1, wherein said key tab is positioned in said oval opening.

3. The door latch of claim 2, wherein said key tab being movable by the turning of a mating key which is inserted into said lock set.

4. The door latch of claim 3, wherein said main lock is spring-biased to return to a latched condition after a lifting action of said engagement end.

5. The door latch of claim 4, wherein said lock bar includes a locking abutment which is movable relative to said latch, said locking abutment being positioned over said latch when in said first position.

6. The door latch of claim 5, wherein said slot-engagement means includes a pin securely received by said latch and positioned in said slot.

7. The door latch of claim 6, wherein said main lock and said latch are constructed and arranged to move in unison when said lock bar is in said second position.

8. The door latch of claim 7, wherein said main lock and said latch are constructed and arranged such that said main lock is movable independently of said latch when said lock bar is in said first position.

9. A door latch for securing a door of a building in a closed condition relative to an abutment surface which includes a securing member for engagement by said door latch, said door latch comprising:

a housing formed with two spaced-apart side panels and an end panel;

a handle rod received by each of said side panels;

a lock received by a first one of said side panels and including a movable key tab;

a main lock including a handle end, an engagement end, a slot, and defining a receiving aperture for receiving said handle rod, said main lock being constructed and arranged to pivot so as to lift said engagement end out of engagement with said securing member;

a latch defining a receiving aperture for receiving said handle rod and including slot-engagement means for operatively coupling with said slot;

a lock bar mounted to said first one of said side panels and being movable relative to said first one of said side panels between a first position and a second position; and wherein when said lock bar is in said first position, said main lock is not movable from a position exterior to said building by use of said handle rod, said main lock being movable from a position interior to said building.

10. The door latch of claim 9, wherein said lock bar defines an oval opening.

11. The door latch of claim 10, wherein said key tab is positioned in said oval opening.

12. The door latch of claim 11, wherein said key tab being movable by the turning of a mating key which is inserted into said lock.

13. The door latch of claim 12, wherein said main lock is spring-biased to return to a latched condition after a lifting action of said engagement end.

14. The door latch of claim 13, wherein said lock bar includes a locking abutment which is movable relative to said latch, said locking abutment being positioned over said latch when in said locked position.

15. The door latch of claim 14, wherein said slot-engagement means includes a pin securely received by said latch and positioned in said slot.

16. The door latch of claim 15, wherein said main lock and said latch are constructed and arranged to move in unison when said lock bar is in said unlocked position.

17. The door latch of claim 16, wherein said main lock and said latch are constructed and arranged such that said main lock is movable independently of said latch when said lock bar is in said locked position.

18. The door latch of claim 9, wherein said main lock is spring-biased to return to a latched condition after a lifting action of said engagement end.

19. The door latch of claim 9, wherein said lock bar includes a locking abutment which is movable relative to said latch, said locking abutment being positioned over said latch when in said locked position.

20. The door latch of claim 9, wherein said slot-engagement means includes a pin securely received by said latch and positioned in said slot.

21. The door latch of claim 20, wherein said main lock and said latch are constructed and arranged to move in unison when said lock bar is in said unlocked position.

22. The door latch of claim 21, wherein said main lock and said latch are constructed and arranged such that said main lock is movable independently of said latch when said lock bar is in said locked position.

23. The door latch of claim 9, wherein said lock bar includes a release lever which is only accessible from a position interior to said building.

24. The door latch of claim 9, wherein said handle end is constructed and arranged such that it is only accessible from a position interior to said building.

* * * * *